United States Patent [19]

Gorring et al.

[11] 4,021,334

[45] May 3, 1977

[54] PROCESS FOR MANUFACTURE OF STABILIZED LUBRICATING OIL WITH ELEMENTAL SULFUR

[75] Inventors: Robert L. Gorring, Washington Crossing, Pa.; Eric J. Y. Scott, Princeton; Robert L. Smith, Hopewell, both of N.J.

[73] Assignee: Mobil Oil Corporation, New York, N.Y.

[22] Filed: June 8, 1976

[21] Appl. No.: 693,828

Related U.S. Application Data

[63] Continuation-in-part of Ser. No. 495,591, Aug. 8, 1974, Pat. No. 3,972,853.

[52] U.S. Cl. ..... 208/211; 208/293; 252/45

[51] Int. Cl.[2] ..... C10G 23/02; C10M 1/08

[58] Field of Search ..... 208/293, 216, 211; 252/45

[56] References Cited

UNITED STATES PATENTS

| | | | |
|---|---|---|---|
| 2,222,431 | 11/1940 | Colin | 252/45 |
| 2,985,586 | 5/1961 | Willson et al. | 208/216 |
| 3,016,350 | 1/1962 | Butler et al. | 208/216 |
| 3,020,228 | 2/1962 | Demeester | 208/216 |
| 3,218,251 | 11/1965 | Demeester | 208/216 |
| 3,228,875 | 1/1966 | Demeester | 208/216 |
| 3,917,566 | 11/1975 | Scott et al. | 208/293 |
| 3,972,853 | 8/1976 | Gorring et al. | 208/293 |

*Primary Examiner*—George Crasanakis
*Attorney, Agent, or Firm*—Charles A. Huggett; Raymond W. Barclay; Dennis P. Santini

[57] ABSTRACT

A stabilized lubricating oil resistant to oxidation and sludge formation upon exposure to an oxidative environment is prepared without forming undesirable color bodies therein by the steps (1) contacting the lubricating oil stock with a small amount of added elemental sulfur of from about 0.05 to about 1.0 percent by weight at a contact temperature of from about 25° C to about 130° C and (2) contacting the product of step (1) with hydrogen in the presence of alumina impregnated with at least about 10 weight percent $MoO_3$ and at least about 2.5 weight percent CoO to remove any unreacted added elemental sulfur therefrom. The impregnated alumina catalyst of step (2) must have at least 50 percent of the pores with a pore diameter of 50 Angstrom Units or more.

12 Claims, No Drawings

PROCESS FOR MANUFACTURE OF STABILIZED LUBRICATING OIL WITH ELEMENTAL SULFUR

CROSS-REFERENCE TO RELATED APPLICATIONS

This is a continuation-in-part of application Ser. No. 495,591, filed Aug. 8, 1974, now U.S. Pat. No. 3,972,853.

BACKGROUND OF THE INVENTION

1. Field of the Invention

This invention relates to the production of improved lubricating oils. In particular, it relates to the preparation of stable lubricating oils without sacrifice in color which are highly resistant to oxidation and sludge formation when exposed to a highly oxidative environment.

2. Description of Prior Art

Hydrocarbon lubricating oils have been obtained by a variety of processes in which high boiling fractions are contacted with hydrogen in the presence of hydrogenationdehydrogenation catalysts at elevated temperatures and pressures. In such processes, there is a consumption of hydrogen. Lubricating oil fractions are separated from the resulting products. Such lubricating oil fractions differ from those obtained by fractional distillation of crude oils and the like, since they have such relatively high viscosity index values that solvent extraction treatments are generally not required to enhance their viscosity index values. Such lubricating oil fractions suffer from the shortcoming that they are unstable when exposed to highly oxidative environments. When so exposed, sediment and lacquer formation occurs, thus lessening the commercial value of such lubricants.

Methods in the art directed to lessening such a shortcoming are exemplified by U.S. Pat. Nos. 3,436,334 and 3,530,061. They teach making a lubricating oil product fraction of hydrocracking resistant to deterioration upon exposure to light and air by contacting the lubricating oil fraction with a solid contacting agent having hydrogenation-dehydrogenation properties under hydrogen pressure (U.S. Pat. No. 3,530,061); and making hydrocarbon lubricating oil resistant to such deterioration by contacting high boiling hydrocarbons with a hydrogenation-dehydrogenation catalyst and hydrogen (with hydrogen consumption), and thereafter dehydrogenating the resultant product on contact with a metal oxide or with metal and oxygen (U.S. Pat. No. 3,436,334). Both methods employ hydrogen atmosphere, high pressure and high temperature, i.e. 500° to 1000° F. No sulfur is employed in either patent method.

U.S. Pat. No. 2,914,470 is directed to hydrorefining a petroleum oil fraction by contacting it with a catalyst in the presence of hydrogen sulfide. Temperatures and pressures taught for the process of this patent are 600° to 825° F and 150 psig to 3000 psig, respectively.

U.S. Pat. No. 2,432,440 is directed to a high temperature, high sulfur treatment of lubricating oil stocks to improve oxidative stability.

The present invention is directed to a process and means for effecting substantial improvement in oxidative properties of lubricating oil by a low pressure, low temperature contacting with a small amount of added elemental sulfur in the absence of a catalyst followed by removal of unreacted added elemental sulfur. Intrinsic, organically-bound sulfur present in the oil is not substantially removed by the second step of the present process.

U.S. Pat. No. 2,604,438 teaches a "hydroforming" process for catalytic dehydrogenation of light (i.e. boiling at less than 600° F) hydrocarbon oils, presumably to increase aromatic content. The patent discloses the known fact that in processes of that nature, the presence of a small amount of sulfur in the feed has a beneficial effect. It further states that when the oil to be hydroformed has no sulfur, i.e. no sulfur in the light hydrocarbon feed, then a small amount of sulfur, e.g., a reducible sulfur compound, is added to the feed. The patent emphasizes that the invention disclosed therein is only advantageous when the process is carried out at a temperature of at least 825° F.

The prior art practices of hydrofinishing and hydrotreating as a means of treatment of lubricating oil stocks (i.e. stocks boiling at temperatures over 600° F) leave behind the unstable oil fractions, i.e., hydroaromatic compounds, with labile hydrogen atoms such as, for example, fluorenes, benzofluorenes, acenaphthenes, tetralin, fused cycloalkylaromatics and naphthenes, which are quite unstable toward oxygen, particularly in the presence of metals in lubricating oil formulations containing overbased additives. These hydroaromatic compounds with labile hydrogen atoms are known to be present in small quantities in conventionally furfural refined stocks and can lead to oxidative instability of any lubricant containing them. Further, it is well known that the sensitivity of certain lubricating oils toward alkaline additives can cause oxidative degradation in applications where overbased additives are used, such as automotive and diesel lubricants. Also, metal sensitivity can be quite detrimental to the oxidative stability of lubricants or functional fluids in applications such as turbine circulating oils, steam turbine oils and hydraulic fluids. No method is known at present which so effectively and easily alleviates the above problems as the present two-step invention.

SUMMARY OF THE INVENTION

In accordance with the present invention there is provided a two-step process and means for forming lubricating oils which are highly resistant to deterioration, e.g. oxidation and sludge formation, upon exposure to a highly oxidative environment.

The process of the present invention comprises the steps of (1) contacting a lubricating oil stock, such as, for example, from a Midcontinental U.S.A. crude or an Arabian Light crude, with added elemental sulfur in amount of from about 0.05 to about 1.0 percent by weight of the oil stock at a mild temperature of from about 25° to about 130° C and, thereafter, (2) contacting the product of step (1) with hydrogen in the presence of alumina impregnated with at least about 10 weight percent $MoO_3$ and at least about 2.5 weight percent CoO, said impregnated alumina having at least 50 percent of the pores thereof with a pore diameter of 50 Angstrom Units or more.

The elemental sulfur for use in step (1) herein may be added as such or may be generated in situ, and therefore, may be provided for the process, if desired, by a sulfur precursor, such as, for example, $H_2S$, or an added organosulfur compound.

Non-limiting examples of sulfur precursors which may be utilized in the present process include $H_2S$, RSH, $RS_xH$, $HS_xH$ and $RS_xR$, wherein R is a hydrocarbyl group and x is an integer of from 1 to 4 or more.

The preferred form of sulfur for use herein is crystalline, such as that produced by recrystallization of sublimed sulfur from toluene.

The sulfur-removal mechanism of step (2) of this process is distinct from conventional hydrotreating procedures employed in the art to remove organically-bound sulfur from heavy oils. As exemplified hereinafter, this process does not lead to substantial reduction in organically-bound sulfur, i.e., only excess added elemental sulfur is removed hereby.

DESCRIPTION OF SPECIFIC EMBODIMENTS

The lubricating oil stock which may be treated in accordance with the present invention may generally be any high boiling range material boiling above about 600° F. Such lubricating oil stock materials include those obtained by fractionation, as by, for example, vacuum distillation, of crude oils identified by their source, i.e. Pennsylvania, Midcontinent, Gulf Coast, West Texas, Amal, Kuwait, Barco and Arabian. Said oil stock material may be one having a substantial part thereof of the fractionation product of the above crude oils mixed with other oil stocks.

The elemental sulfur employed in step (1) of the present process may be crystalline, amorphous or colloidal and may be any of several allotropic forms such as $S_6$, $S_8$ or polymeric sulfur, and may be used in small amounts of from about 0.05 to about 1.0 percent by weight of oil stock, with a preferable range of from about 0.1 to about 0.5 percent by weight. It is readily observable that this invention differs from the well-known method of making sulfurized oil-extreme pressure agents in conditions of processing, the concept of improvement, the amount and type of sulfur incorporated and the chemical modification of the oil stock itself. In the present invention, small amounts of stable sulfur may possibly be chemically incorporated into the oil molecules as labile hydrogen atoms are removed. On the other hand, in sulfurized oils used as extreme pressure agents, large quantities of sulfur, such as, for example, 10 to 15 percent by weight, are incorporated, including a substantial quantity of elemental sulfur as such.

The operating parameters in step (1) of the present process are generally such as to achieve the desired result of degree of improvement or upgrading product quality of the lubricating oil stock treated without loss in yield and without forming undesirable color bodies therein. In step (1), aside from specific small amounts of sulfur, the temperature must be within the range of from about 25° to about 130° C, with a preferred range of from about 25° to 70° C. Also, the pressure in step (1) must be within the range of from about 0 psig to about 100 psig, with a preferred range of from about 0 psig to about 5 psig. Contact time in step (1) may vary from about 0.1 hour to about 10 hours or more, preferably from about 0.5 hour to about 4 hours or more.

Operating parameters in step (2) of the present process are critical, especially reaction pressure since the second step reaction is pressure dependent whereby too great a pressure will cause undesirable hydrogenating of the oil product from the first step of the process. The reaction pressure of the second step must be maintained within the range of from about 100 psig to about 300 psig, with a preferred pressure being within the range of from about 150 psig to about 250 psig. Reaction temperature should be maintained within the range of from about 80° to about 190° C, with a preferred temperature within the range of from about 150° to about 175° C. Hydrogen must be present in the second step of this process with hydrogen circulating being maintained within the range of from about 100 scf/bbl to about 1500 scf/bbl, preferably from about 500 scf/bbl to about 1100 scf/bbl. The second step of this process may be conducted in a flow reactor or under conditions comparable to those existing in a flow reactor with a liquid hourly space velocity of from about 0.1 $hr^{-1}$ to about 10 $hr^{-1}$ (vol. oil/vol. catalyst), preferably from about 0.5 $hr^{-1}$ to about 2.5 $hr^{-1}$.

The catalyst material employed in step (2) must be alumina impregnated with at least about 10 weight percent $MoO_3$ and at least about 2.5 weight percent CoO. The impregnated alumina must have at least 50 percent of the pores with a pore diameter of 50 Angstrom Units or more. Other catalyst materials, although having large pore size distribution, such as, for example, alumina impregnated with Fe-Cr-K, alumina impregnated with $MoO_3$ alone and other catalysts of alumina impregnated with CoO and $MoO_3$, do not provide the desired results achieved by the present process. The alumina catalyst for the second step must, more specifically, be impregnated with from about 2.5 to about 4 weight percent CoO, preferably from about 2.5 to about 3.5 weight percent; and from about 10 to about 15 weight percent $MoO_3$, preferably from about 10.5 to about 13.5 weight percent. The order and method of impregnation is not critical.

In order to more fully illustrate the process of the present invention, the following specific examples, which in no sense limit the invention, are presented. The basic test procedure employed in evaluation of product yield from the present process is the standard Rotary Bomb Oxidation Test (RBOT) designated ASTM-D2272, ASTM-D2272 was carried out to test oxidation properties of an oil blend, the base stock of which was prepared in accordance with the present invention. Each sample tested was blended with a standard commercial additive package prior to testing.

The lubricating oil stock used in the following examples was conventionally refined by distillation, followed by furfural extraction and methyl ethyl ketone dewaxing. It is identified in Table 1 according to source, physical properties and furfural extraction conditions.

TABLE 1

CRUDE SOURCE AND NOMINAL VISCOSITY OF LUBRICATING OIL STOCK USED HEREIN

| | 150 S.U.S. Arabian Light |
|---|---|
| Furfural Dosage, % Volume | 180 |
| Tower Temp., ° F Top | 185 |
| Tower Temp., ° F Bottom | 140 |
| Gravity, ° API | 30.9 |
| Pour Pt., ° F | 0 |
| Flash Pt., ° F | 410 |
| Organically-bound sulfur, % wt. | 0.63 |
| Nitrogen, % wt. | 0.0029 |
| Aniline Point, ° F | 210 |
| Viscosity, S.U.S. at 100° F | 152 |
| Viscosity Index | 103 |
| ASTM Color | 1½ |

EXAMPLE 1

A 50 gram quantity of the above oil stock, without treatment in accordance with the present invention, was subjected to the RBOT test. The result of the test was 268 minutes.

EXAMPLE 2

Step 1

A 50 gram quantity of the above-identified oil stock was charged into an ultrasonic bath container and contacted with 0.1 weight percent elemental sulfur (obtained by recrystallization of sublimed sulfur from toluene) during ultrasonic agitation at 120° C for 2 hours.

Step 2

The sulfur-containing oil product from step (1) was then contacted with hydrogen under a pressure of 200 psig, a temperature of 160° C and a LHSV of 1 $hr^{-1}$ in the presence of 10 grams of alumina impregnated with 13.1 weight percent of $MoO_3$ and 2.5 weight percent of CoO. The hydrogen circulation rate was 1000 scf/bbl.

The impregnated alumina catalyst had the following properties:

| | |
|---|---|
| Pore Volume, cc/g | 0.512 |
| Packed Density, g/cc | 0.771 |
| Pore Size Distribution, cc/cc | |
| 0 – 50 A | 0.069 |
| 50 – 100 | 0.230 |
| 100 – 150 | 0.073 |
| 150 – 200 | 0.004 |
| >200 | 0.019 |

The impregnated alumina catalyst was pre-sulfided by passing $H_2S$ through the catalyst for one hour at 427° C. It was then cooled to 200° C in a stream of $H_2S$ and allowed to cool to room temperature in a stream of hydrogen before use.

The product oil from step (2) was analyzed for sulfur content and tested in the RBOT test. It was found to contain only 0.63 weight percent sulfur, presumably the organically-bound sulfur existing in the oil stock prior to treatment in accordance herewith, indicating that only the excess added elemental sulfur from step (1 ) was removed. The RBOT result was a greatly improved 365 minutes.

EXAMPLE 3

The same two-step procedure as Example 2 is followed, except that in step (1) of this example the sulfur contact is conducted at 62° C. Again, the sulfur content of the finished oil product is 0.63 weight percent and the RBOT is 365 minutes.

EXAMPLE 4

The same two-step procedure as Example 2 was followed, except that in step (1) of this example the sulfur contact was conducted at 62° C and in step (2) the sulfur-containing oil product from step (1) was contacted with hydrogen at 175° C.

The product oil from step (2) was tested in the RBOT test, which indicated a result of 335 minutes.

Having thus given a general description of the process and means of this invention and provided by way of examples specific embodiments thereof, it is to be understood that no undue restrictions are to be imposed by reason thereof, and minor modifications may be made thereto without departing from the scope thereof.

What is claimed is:

1. A process for forming stabilized lubricating oil resistant to oxidation and sludge formation upon exposure to an oxidative environment which comprises the steps of (1) contacting a hydrocarbon lubricating oil stock with elemental sulfur in amount of from about 0.05 to about 1.0 percent by weight of said oil stock at a temperature of between about 25° and about 130° C and pressure of from about 0 psig to about 100 psig for a contact time of from about 0.1 hour to about 10 hours, and (2) contacting the oil product from step (1) with hydrogen and with alumina impregnated with at least about 10 weight percent $MoO_3$ and at least about 2.5 weight percent CoO, said impregnated alumina having at least 50 percent of the pores thereof in a pore diameter of 50 Angstrom units or more, at a temperature of from about 80° to about 190° C, a pressure of from about 100 psig to about 300 psig, a hydrogen circulation rate of from about 100 scf/bbl to about 1500 scf/bbl and a liquid hourly space velocity of from about 0.1 $hr^{-1}$ to about 10 $hr^{-1}$.

2. The process of claim 1 wherein said oil stock has a boiling range of above about 600° F.

3. The process of claim 1 wherein step (1) is conducted in an ultrasonic bath.

4. The process of claim 1 wherein said oil stock comprises a lubricating oil fraction obtained by fractionation of a crude oil identified as Pennsylvania, Midcontinent, Gulf Coast, West Texas, Amal, Kuwait, Barco or Arabian.

5. The process of claim 2 wherein said oil stock comprises at least a substantial part of one obtained by fractionation of a crude oil identified as Pennylvania, Midcontinent, Gulf Coast, Wesst Texas, Amal, Kuwait, Barco or Arabian.

6. The process of claim 1 wherein said oil stock is a lubricating oil fraction obtained by fractionation of crude oil identified as Arabian.

7. The process of claim 1 wherein said elemental sulfur is crystalline.

8. The process of claim 7 wherein said crystalline sulfur is obtained by recrystallization of sublimed sulfur from toluene.

9. The process of claim 1 wherein step (1) is conducted at a temperature of from about 25° to about 70° C, a pressure of from about 0 psig to about 5 psig and a contact time of from about 0.5 hour to about 4 hours or more, and step (2) is conducted at a temperature of from about 150° to about 175° C, a pressure of from about 150 psig to about 250 psig, a hydrogen circulation rate of from about 500 scf/bbl to about 1100 scf/bbl and a liquid hourly space velocity of from about 0.5 $hr^{-1}$ to about 2.5 $hr^{-1}$.

10. The process of claim 9 wherein the hydrocarbon lubricating oil stock is contacted with elemental sulfur in amount of from about 0.1 to about 0.5 percent by weight of said oil stock in step (1).

11. The process of claim 1 wherein the alumina in step (2) is impregnated with from about 2.5 to about 4 weight percent CoO and from about 10 to about 15 weight percent $MoO_3$.

12. The process of claim 9 wherein the alumina in step (2) is impregnated with from about 2.5 to about 3.5 weight percent CoO and from about 10.5 to about 13.5 weight percent $MoO_3$.

* * * * *

UNITED STATES PATENT AND TRADEMARK OFFICE

CERTIFICATE OF CORRECTION

PATENT NO. : 4,021,334

DATED : May 3, 1977

INVENTOR(S) : ROBERT L. GORRING, ERIC J. Y. SCOTT and ROBERT L. SMITH

It is certified that error appears in the above-identified patent and that said Letters Patent are hereby corrected as shown below:

Column 4, line 5 "circulating" should read --circulation--.

Signed and Sealed this second Day of August 1977

[SEAL]

*Attest:*

RUTH C. MASON
*Attesting Officer*

C. MARSHALL DANN
*Commissioner of Patents and Trademarks*